US005636922A

United States Patent [19]

Clark

[11] Patent Number: 5,636,922

[45] Date of Patent: Jun. 10, 1997

[54] HEATED SOAP CHIP RECYCLER

[76] Inventor: Daryl O. Clark, 4203 58th Ave., Apt. 2, Bladensburg, Md. 20710

[21] Appl. No.: 524,327

[22] Filed: Sep. 6, 1995

[51] Int. Cl.[6] ..... B01F 7/16; B01F 15/06

[52] U.S. Cl. ..... 366/145; 366/146; 366/190; 366/314; 222/146.5; 222/321.9; 241/65; 241/282.1

[58] Field of Search ..... 366/145, 146, 366/190, 191, 194, 205, 206, 314, 601, 604; 241/65, 169.1, 282.1, 282.2; 222/226, 229, 233–235, 321.9, 385, 146.5

[56] References Cited

U.S. PATENT DOCUMENTS

| | | | |
|---|---|---|---|
| 1,491,991 | 4/1924 | Lacy et al. | 366/146 |
| 1,771,292 | 7/1930 | Gallipoli | 366/332 |
| 1,956,788 | 5/1934 | Blum | 366/190 X |
| 2,282,866 | 5/1942 | Hagen | 366/206 X |
| 2,700,097 | 1/1955 | Morey | 366/145 X |
| 2,740,558 | 4/1956 | Steele | 222/385 X |
| 3,220,954 | 11/1965 | Malbe | 366/604 X |
| 3,289,897 | 12/1966 | Ginsberg | 366/190 X |
| 3,523,629 | 8/1970 | Chi | 222/385 X |
| 3,750,910 | 8/1973 | Se-kit | 222/385 X |
| 3,863,903 | 2/1975 | Brehmer et al. | 366/279 X |
| 4,296,064 | 10/1981 | Satcher . | |
| 4,497,580 | 2/1985 | Doyel | 366/190 |
| 4,735,345 | 4/1988 | Lee | 222/385 X |
| 5,286,106 | 2/1994 | Burgos | 222/235 X |
| 5,368,387 | 11/1994 | Creighton et al. . | |
| 5,511,882 | 4/1996 | Anwunah et al. | 366/314 |

*Primary Examiner*—Charles E. Cooley
*Attorney, Agent, or Firm*—Chase & Yakimo

[57] ABSTRACT

A soap chip recycler presents a housing having inner and outer walls surrounding an interior, vertical compartment. The compartment presents a lower dissolution zone having a motor-driven blade assembly and a dispenser zone above the dissolution zone. A pump assembly extends through a lid, the latter engaging a rim surrounding an aperture in the top wall of the housing. The pump assembly includes a depending conduit extending into the compartment and terminating above the dissolution zone. The energized coil heats the compartment to a temperature consistent with soap liquefaction. The over/under zone relationship directs any soap particles approaching a solidified state to the bottom of the compartment for pulverization by the blade assembly so as to preclude interference with the pump assembly.

7 Claims, 6 Drawing Sheets

HEATED SOAP CHIP RECYCLER

BACKGROUND 0F THE INVENTION

This invention relates to a soap chip recycler and, more particularly, to a soap chip recycler which enhances the liquefaction of soap chips.

Various devices have been proposed to avoid the waste associated with small pieces of unused soap. One such device is as shown in U.S. Pat. No. 5,368,387 to Creighton. Therein Creighton discloses a device having a main housing divided into side-by-side fluid dispensing and mixing areas, the areas divided by an intermediate screen. An agitator assembly is said to mix the surrounding soap and water with the screen preventing the undissolved chips from flowing into a fluid dispensing area.

Satcher, U.S. Pat. No. 4,296,064, discloses a device which deposits small pieces of soap into a rack, the rack being positioned above a fluid. The rack includes compartments within which the soap chips are placed. Upon heating the fluid the chips are liquified and after heating harden in the rack according to the compartment configuration.

Although assumably effective in their operation, it is desirable to have a device which is easy to manufacture and utilize, enhances the soap chip liquefying process and resulting viscosity and resists the return of the liquified soap chips to a solid state.

In response thereto I have invented a chip recycler which presents a heated housing having an interior compartment presenting a lower dissolution zone and an upper liquid dispensing zone. The heated housing warms the soap chips and surrounding solution to a temperature which urges the newly deposited chips to a liquid state and resists the return of the previously liquified chips to a solid state. The over/under relationship between the dispensing and dissolution zones assures that any soap chips, or portions thereof, which are not liquified will be in the dissolution zone for subsequent pulverization. Dissolution of the newly deposited soap chips dissolves the chips into a liquified form for subsequent dispensation by a pump assembly positioned above the dissolution zone.

It is therefore a general object of the invention to provide a device for soap chips so as to change the same into a liquified form for downstream use and/or further processing.

Another general object of this invention is to provide a device, as aforesaid, which presents a liquified solution having a greater concentration of soap to water.

A further object of this invention is to provide a device, as aforesaid, which enhances the dissolution of the soap chips.

Still another object of this invention is to provide a device, as aforesaid, which enhances the maintenance of the liquified solution.

A still further object of this invention is to provide a device, as aforesaid, which enhances the dispensing of the liquified solution.

A still further object of this invention is to provide a device, as aforesaid, which enhances the dispensing of the liquified solution.

Still a further object of this invention is to provide a device, as aforesaid, which presents a dispensing zone and a dissolution zone in an over/under relationship.

A further object of this invention is to provide a device, as aforesaid, which heats a housing for enhancing the dissolution and dispensing functions.

A further object of this invention is to provide a device, as aforesaid, which heats the liquified solution and/or deposited soap chips to enhance the viscosity of the resulting solution.

Another object of this invention is to provide a device, as aforesaid, which directs solidified soap particles to the dissolution zone.

A particular object of this invention is to provide a device, as aforesaid, which utilizes a dissolution assembly of high efficiency.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
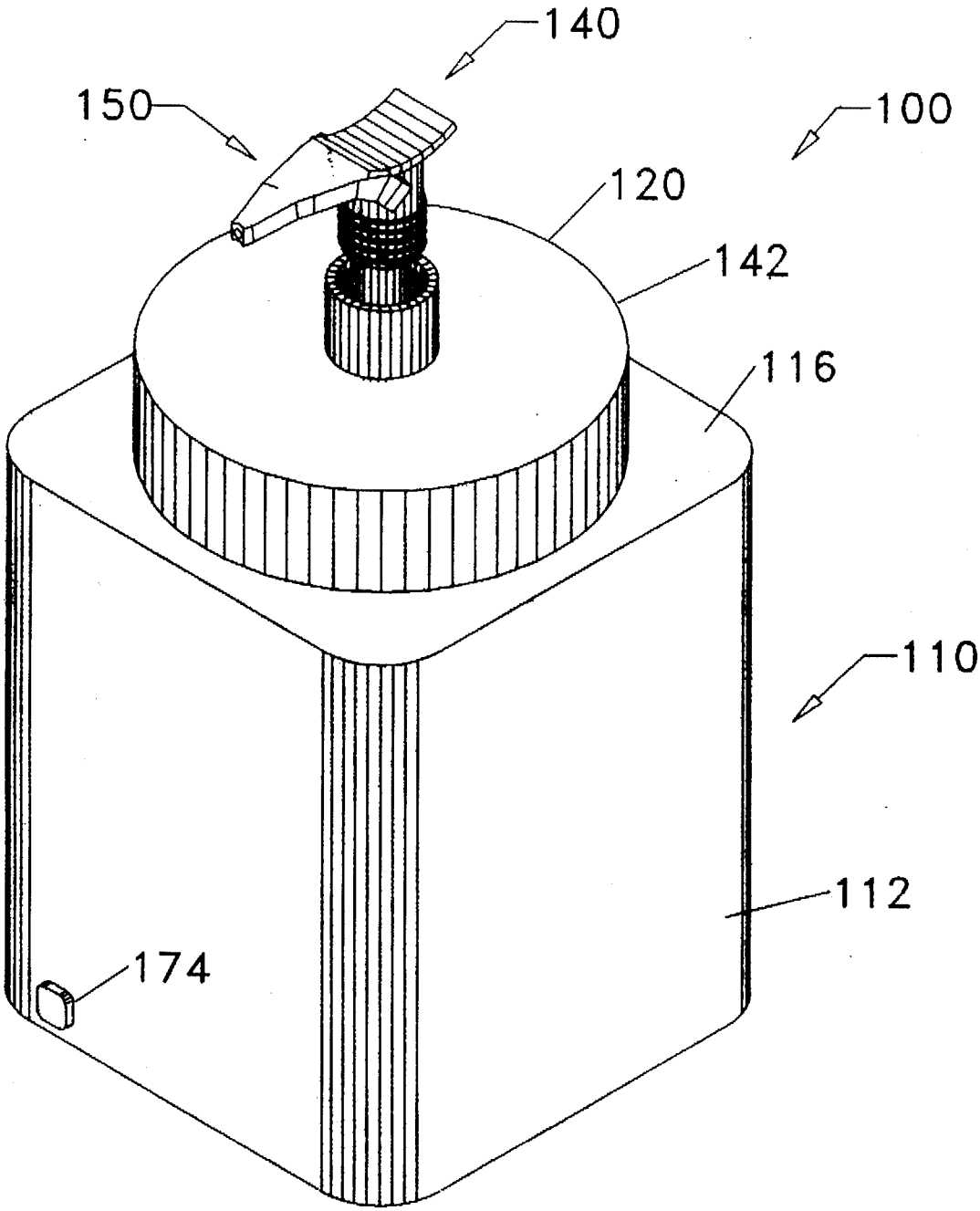
FIG. 1 is a perspective view of the soap chip recycler.
Figure 2:
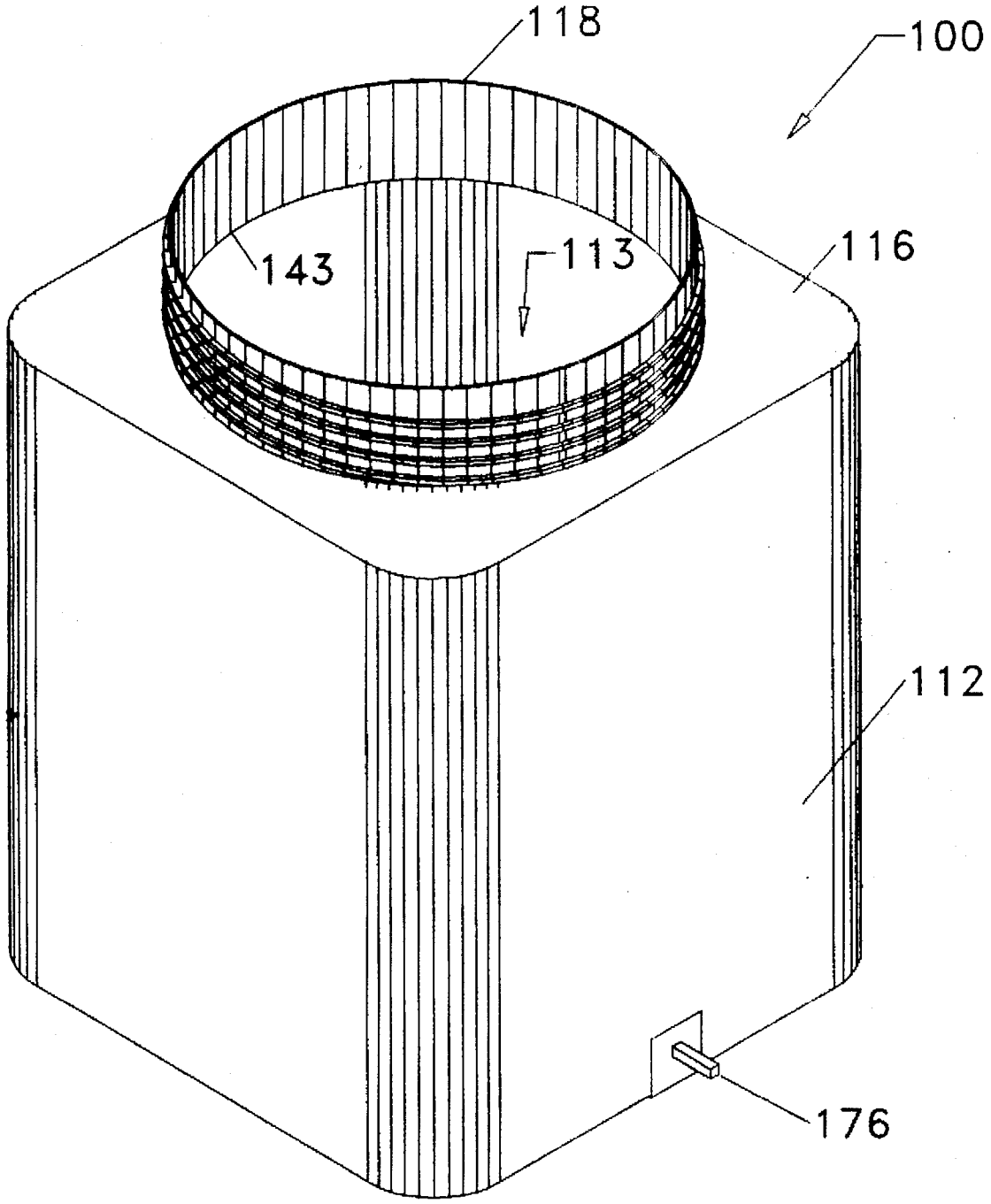
FIG. 2 is a perspective view of an opposed side of the recycler with the pump assembly removed.
Figure 3:
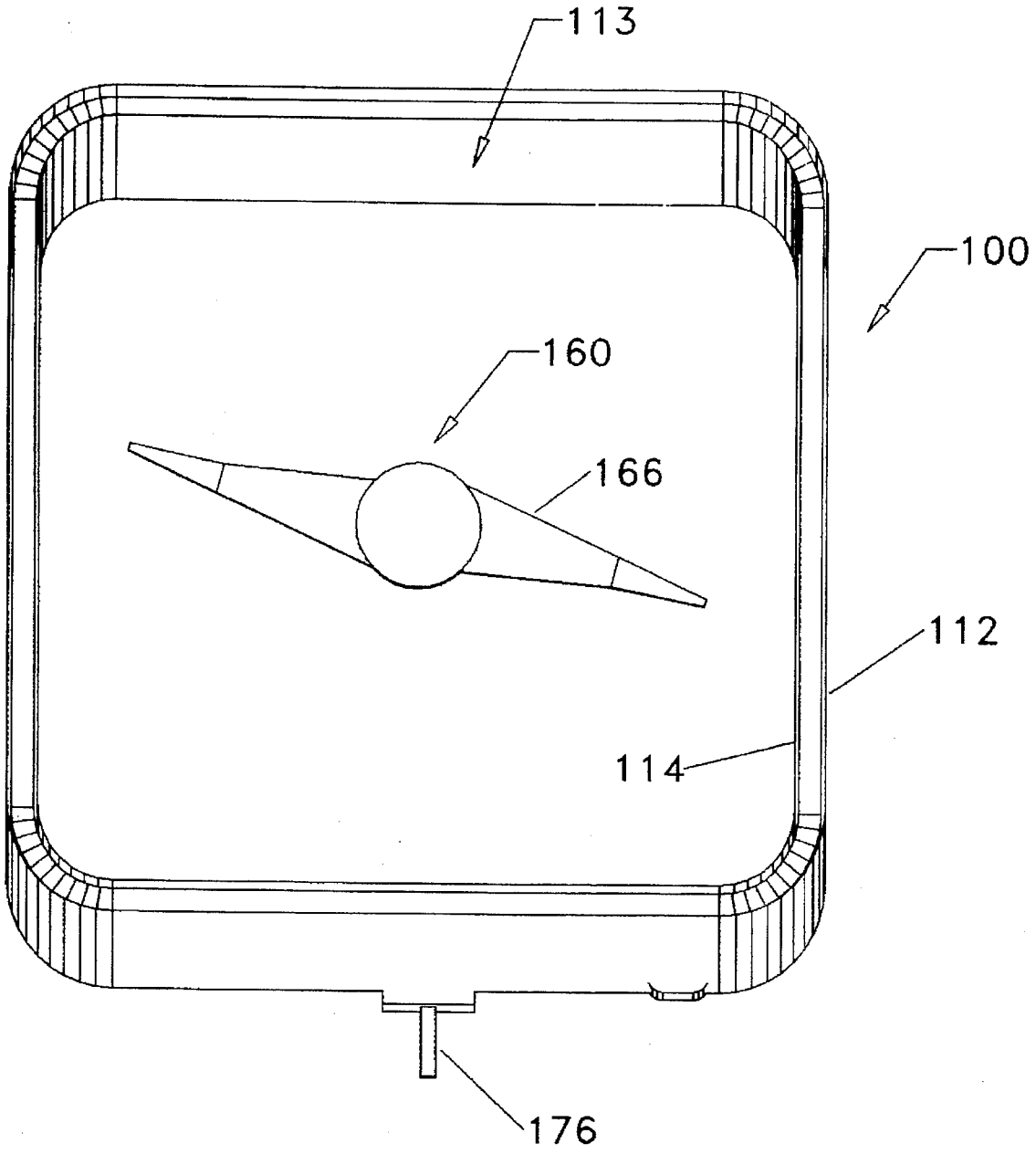
FIG. 3 is a top view of the recycler with the top wall and lid removed to show the interior compartment.
Figure 4:
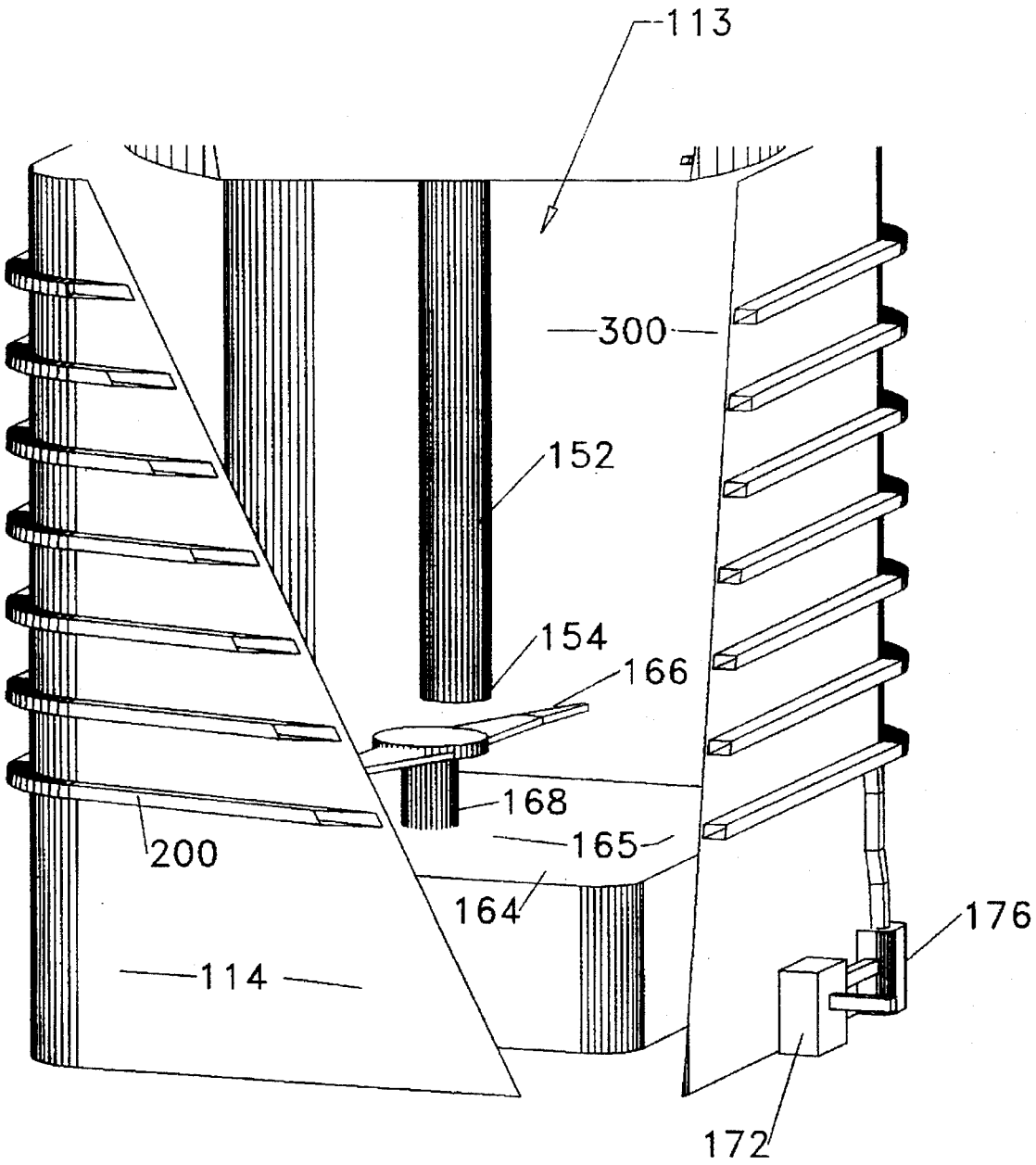
FIG. 4 is a perspective view of the recycler with the outer and top housing walls removed and housing walls partially broken away to show the internal heating coil pump conduit and dissolution assembly.
Figure 5:
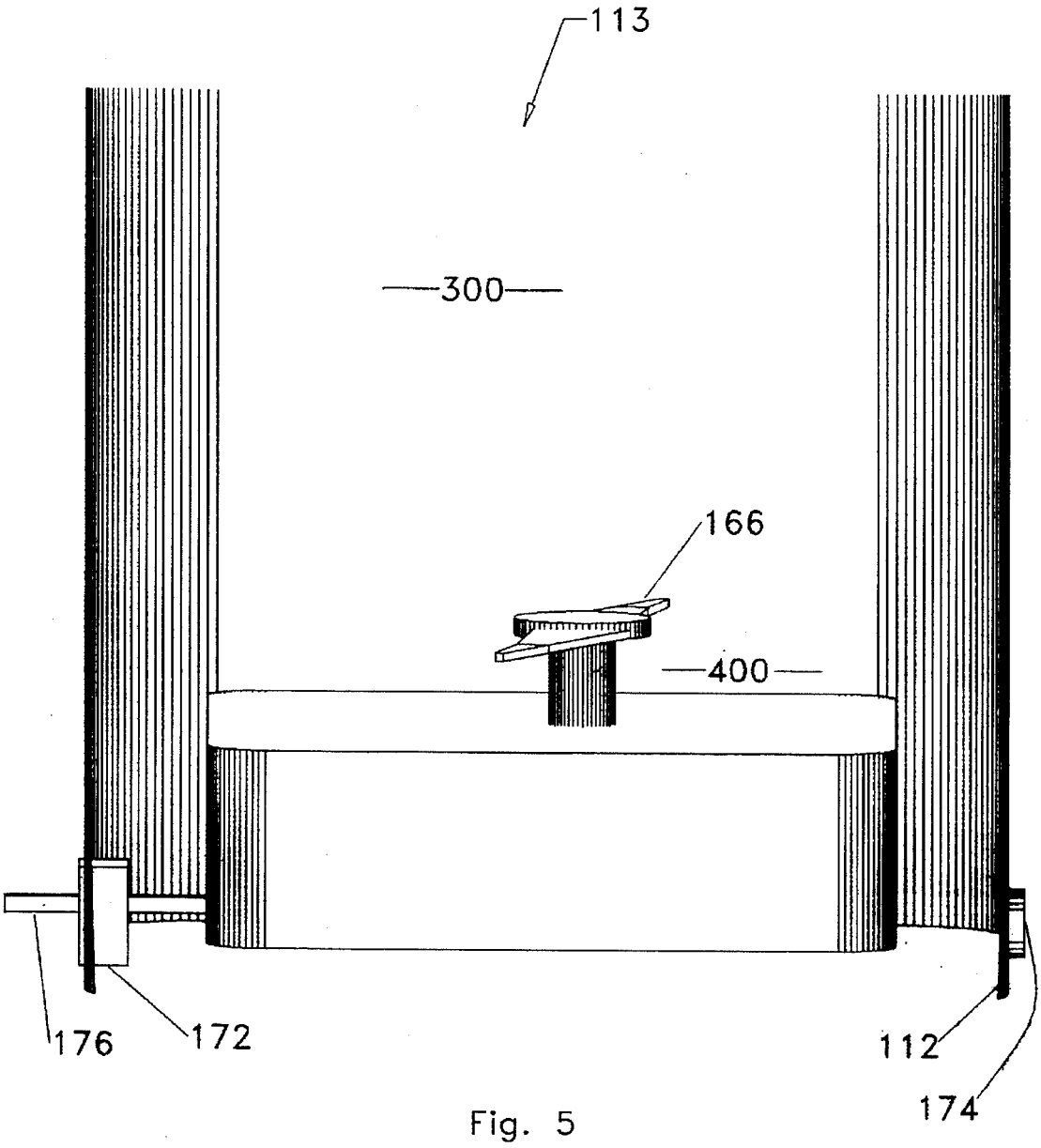
FIG. 5 is a front view of the recycler, on an enlarged scale, with the housing walls removed to show the dissolution assembly therein.

Turning more particularly to the drawings, FIG. 1 shows the recycler 100 as comprising a generally cube-liked housing 110 having an outer wall 112 and inner wall 114. Outer wall 112 is preferably made of an insulated material so as to preclude any heat transfer thereto. Located on the top wall 116 of housing 110 is a threaded rim 118.

Threadably engageable with the rim 118 is a hand pump assembly 140 including a lid 142 with a hand pump 150 extending therethrough. Soap chips and water are deposited through aperture 143 presented by removal of lid 142. Pump 150 includes a conduit 152 extending into the interior compartment 113 of the housing 110 with the free end 154 thereof terminating above the dissolution zone 400, including the dissolution assembly 160 therein. The dissolution assembly 160 includes a motor housing 165 below the dissolution zone 400 of housing 110 with a powered shaft 168 extending through a bottom wall 165. Attached to the shaft 168 is a blade 166 similar to a blade found in a food processor or the like.

Figure 6:
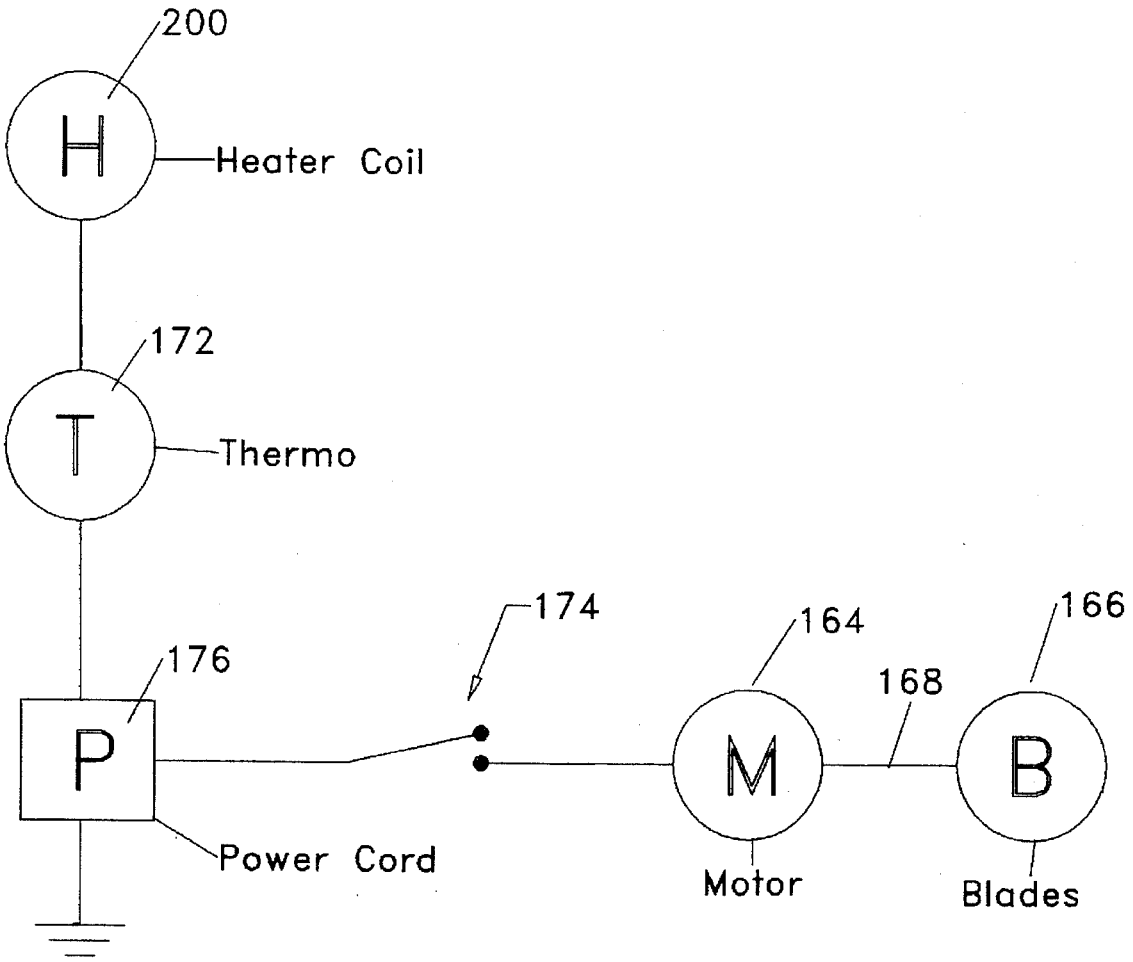
FIG. 6 is a diagrammatic view showing one form of the circuitry used in the recycler.

Motor 164 is part of electrical circuit (FIG. 6) which includes thermostat 172 and switch 174 for delivering power to motor 164 via line cord 176. Line cord 176 is connected to an electrical power source such as an electrical outlet or the like. Alternatively, internal replaceable batteries may be used as a power source so as to eliminate the line cord 176.

Located between the housing walls 112, 114 is an electric heating coil 200 connected to the electrical circuit and wound about the housing so as to circumscribe the upper 300 and lower 400 areas of the housing 110 compartment. The coil 200 thus delivers heat about the whole interior compartment 113 of the housing 110.

As shown the heat is delivered to the coil 200 through the line 176, the current being regulated by a thermostat 172. The temperature of the coil should heat the compartment 113 to a temperature which urges the newly deposited soap chips towards a liquified state and maintains the soap solution in a liquified state.

Depression of the switch 174 energizes the motor 164 which rotates the shaft 168 and the blades 166 thereon. This blades 166, preferably being of a food processor-type configuration, breaks down/pulverizes any soap chip and/or particles found in the dissolution zone 400 which surrounds the blades 166. This pulverizing action coupled with the heating of the liquified solution and solid soap particles in compartment 113 enhances the liquefaction function.

Subsequently the liquified solution above the dissolution assembly 160 may be withdrawn from housing 110 by the pump assembly 140. The heat delivered to compartment 113 by coil 200 will enhance the viscosity of the solution and thus this dispensing function. The over/under relationship between the dispensing zone 300 and dissolution zone 400 assures that solid soap particles will not clog the pump assembly 140 as such particles will fall to the underlying dissolution zone 400 for subsequent break down upon subsequent depression of the switch 174.

Also, the use of the recycler 100 as above described, precludes solidification of the previously liquified particles due to the continuous delivery of heat to the housing compartment 113. This heat transfer will urge the soap chips/particles towards a temperature which precludes solidification and enhance liquefaction. A solution of higher soap density results as the amount of water needed for liquefaction may be reduced, if not eliminated. Accordingly, the combination of the heated compartment 113 along with the over/under relationship of the dispensing 300 and dissolution 400 zones of the housing 110 presents an effective soap recycler for easy and trouble free use.

It is to be understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. Apparatus for processing soap chips into a liquid solution and dispensing the solution for downstream use comprising:

a housing having an interior compartment including a base and a top wall vertically spaced from said base, said compartment including a dissolution zone at a bottom of said housing including said base for the soap chips and a dispensing zone above said dissolution zone;

access means in said housing for deposit of soap chips into said compartment;

means extending from said base and in said dissolution zone only for pulverizing the soap chips placed therein;

fluid dispensing means extending through said top wall and having a conduit with a free end positioned in said dispensing zone and above said pulverizing means in said dissolution zone for removing a solution found in said dispensing zone only from said housing, the solution including liquified soap chips;

an electrical coil wound about said housing between said top wall and base for transfer of heat to soap chips and liquid in said compartment upon energization of said coil, the heat transferred to the soap chips and liquid in said compartment;

circuit means for energizing said coil and said pulverizing means, said circuit including a thermostat for regulating the delivery of current from said circuit means to said coil, whereby said heat from said coil cooperates with said pulverizing means to convert and maintain the soap chips into a liquified form.

2. The apparatus as claimed in claim 1 wherein said pulverizing means comprises:

a motor below said base of said compartment;

a shaft extending from said motor and into said dissolution zone;

a blade connected to said shaft and defining an upper extent of said dissolution zone, a rotation of said blade pulverizing the soap chips.

3. The apparatus as claimed in claim 1 wherein said fluid dispensing means comprises:

a pump assembly including said conduit;

means for releasably connecting said pump assembly to said top wall of said housing, said pump assembly conduit extending below said top wall, said conduit having said free end terminating in said dispensing zone.

4. The apparatus as claimed in claim 3 wherein said access means comprises a lid, said lid threadably engageable with a rim surrounding an aperture in said top wall of the housing.

5. The apparatus as claimed in claim 4 wherein a portion of said pump assembly extends through said lid.

6. The apparatus as claimed in claim 1 wherein said circuit means includes a switch for user selectable energization of said pulverizing means.

7. Apparatus for processing soap chips into a liquid solution and dispensing the solution for downstream use comprising:

a housing having an interior vertical compartment, said compartment including a dissolution zone at a bottom of said housing for the soap chips and a dispensing zone above said dissolution zone;

means about said compartment for heating the soap chips and any liquid solution therein;

a motor-driven blade assembly in said dissolution zone only for breaking down soap matter, including the soap chips, into particles for mixture with the solution, the chips being heated to a temperature by said heating means, said soap matter either being manually inserted into said housing or being solidified soap matter falling from said dispensing zone into said dissolution zone;

fluid dispensing means positioned entirely above said dissolution zone for removing solution found in said dispensing zone only from said housing, the solution being generally free of solidified soap matter;

circuit means for selectably energizing a coil circumscribing a vertical extent of said compartment whereby heat from said coil converts the soap chips into a liquified form and maintains said liquified chips at a liquid state.

* * * * *